US008376153B1

(12) United States Patent
Lee

(10) Patent No.: US 8,376,153 B1
(45) Date of Patent: Feb. 19, 2013

(54) TOOL RACK

(76) Inventor: Hong-Jen Lee, Taichung (TW)

( * ) Notice: Subject to any disclaimer, the term of this patent is extended or adjusted under 35 U.S.C. 154(b) by 0 days.

(21) Appl. No.: 13/282,463

(22) Filed: Oct. 27, 2011

(51) Int. Cl.
*A47F 7/00* (2006.01)
*B65D 85/28* (2006.01)

(52) U.S. Cl. ..... 211/70.6; 206/377

(58) Field of Classification Search ..... 211/70.6, 211/69, 60.1; 248/224.8, 222.41, 225.21, 248/291.1; 206/377, 376, 349, 493
See application file for complete search history.

(56) References Cited

U.S. PATENT DOCUMENTS

| | | | | |
|---|---|---|---|---|
| 1,438,900 | A * | 12/1922 | Chase | 206/375 |
| 4,858,302 | A * | 8/1989 | Stribiak | 483/3 |
| 5,862,913 | A * | 1/1999 | Chou | 206/378 |
| 5,931,318 | A * | 8/1999 | Shauo | 211/70.6 |
| 5,967,340 | A * | 10/1999 | Kao | 211/70.6 |
| 6,050,409 | A * | 4/2000 | Delbeck et al. | 206/375 |
| 6,092,655 | A * | 7/2000 | Ernst | 206/378 |
| 6,092,656 | A * | 7/2000 | Ernst | 206/378 |
| 6,095,329 | A * | 8/2000 | Kao | 206/378 |
| 6,131,740 | A * | 10/2000 | Huang | 206/759 |
| 6,283,291 | B1 * | 9/2001 | Vasudeva et al. | 206/373 |
| 6,386,363 | B1 * | 5/2002 | Huang | 206/378 |
| 6,415,933 | B1 * | 7/2002 | Kao | 211/70.6 |
| 6,450,338 | B1 * | 9/2002 | Chen | 206/378 |
| 6,488,151 | B2 * | 12/2002 | Ramsey et al. | 206/378 |
| 6,547,074 | B1 * | 4/2003 | Chen | 206/379 |
| 6,669,032 | B2 * | 12/2003 | Kao | 211/70.6 |
| 6,698,600 | B1 * | 3/2004 | Lee | 211/70.6 |
| 6,854,607 | B2 * | 2/2005 | Tong | 211/70.6 |
| 6,866,147 | B2 * | 3/2005 | Barwick | 206/363 |
| 6,902,058 | B1 * | 6/2005 | Chang | 206/378 |
| 6,988,616 | B2 * | 1/2006 | Chen | 206/379 |
| 7,066,339 | B2 * | 6/2006 | Chiu et al. | 211/70.6 |
| 7,255,229 | B2 * | 8/2007 | Roesler | 206/379 |
| 7,325,682 | B2 * | 2/2008 | Seymour et al. | 206/379 |
| 7,428,970 | B2 * | 9/2008 | Chen | 206/372 |
| D578,307 | S * | 10/2008 | Chan et al. | D3/295 |
| 7,624,863 | B2 * | 12/2009 | Meng | 206/349 |
| 7,699,176 | B2 * | 4/2010 | Lin | 206/759 |
| 7,726,479 | B2 * | 6/2010 | Vasudeva | 206/379 |
| 7,841,480 | B2 * | 11/2010 | Hsieh | 211/70.6 |
| 8,205,758 | B2 * | 6/2012 | Shih | 211/70.6 |
| 8,302,785 | B2 * | 11/2012 | Kao | 211/70.6 |
| 8,307,980 | B1 * | 11/2012 | Kao | 206/378 |
| 2001/0001197 | A1 * | 5/2001 | Ramsey et al. | 206/378 |
| 2003/0024837 | A1 * | 2/2003 | Chen | 206/378 |
| 2003/0070999 | A1 * | 4/2003 | Kao | 211/70.6 |
| 2003/0102275 | A1 * | 6/2003 | Kao | 211/70.6 |
| 2003/0213760 | A1 * | 11/2003 | Lee | 211/70.6 |
| 2004/0188366 | A1 * | 9/2004 | Tong | 211/70.6 |
| 2005/0230335 | A1 * | 10/2005 | Chiu et al. | 211/70.6 |
| 2006/0207951 | A1 * | 9/2006 | Wang | 211/70.6 |

(Continued)

*Primary Examiner* — Joshua J Michener
*Assistant Examiner* — Devin Barnett

(57) ABSTRACT

A tool rack includes a base, two side boards and a frame. The base includes multiple blocks and is located between the two side boards. Each side board has an elongate slot and two ridges between which a space is defined. The elongate slot has a first recess defined in the top inner end thereof and the first recess is located higher than a top of one of the ridges. A second recess is defined in the bottom inner end of the elongate slot. The frame has multiple extensions and tools are positioned between the blocks and the extensions. Two side links extend from two ends of the frame. When the frame is mounted to the base, the side links are slidably engaged with the spaces of the side boards. The side links each have a pivot which is movably engaged with the elongate slot and each of the recesses.

6 Claims, 11 Drawing Sheets

U.S. PATENT DOCUMENTS

2009/0120885 A1* 5/2009 Kao ..... 211/70.6
2009/0145865 A1* 6/2009 Yu ..... 211/70.6
2009/0288974 A1* 11/2009 Pistor et al. ..... 206/377
2011/0089126 A1* 4/2011 Hsieh ..... 211/70.6
2012/0061339 A1* 3/2012 Chang ..... 211/70.6
2012/0138553 A1* 6/2012 Kao ..... 211/70.6

* cited by examiner

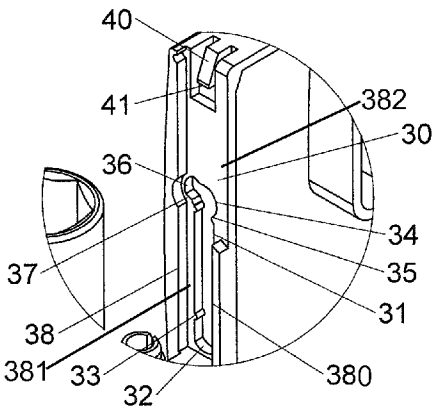
FIG.2
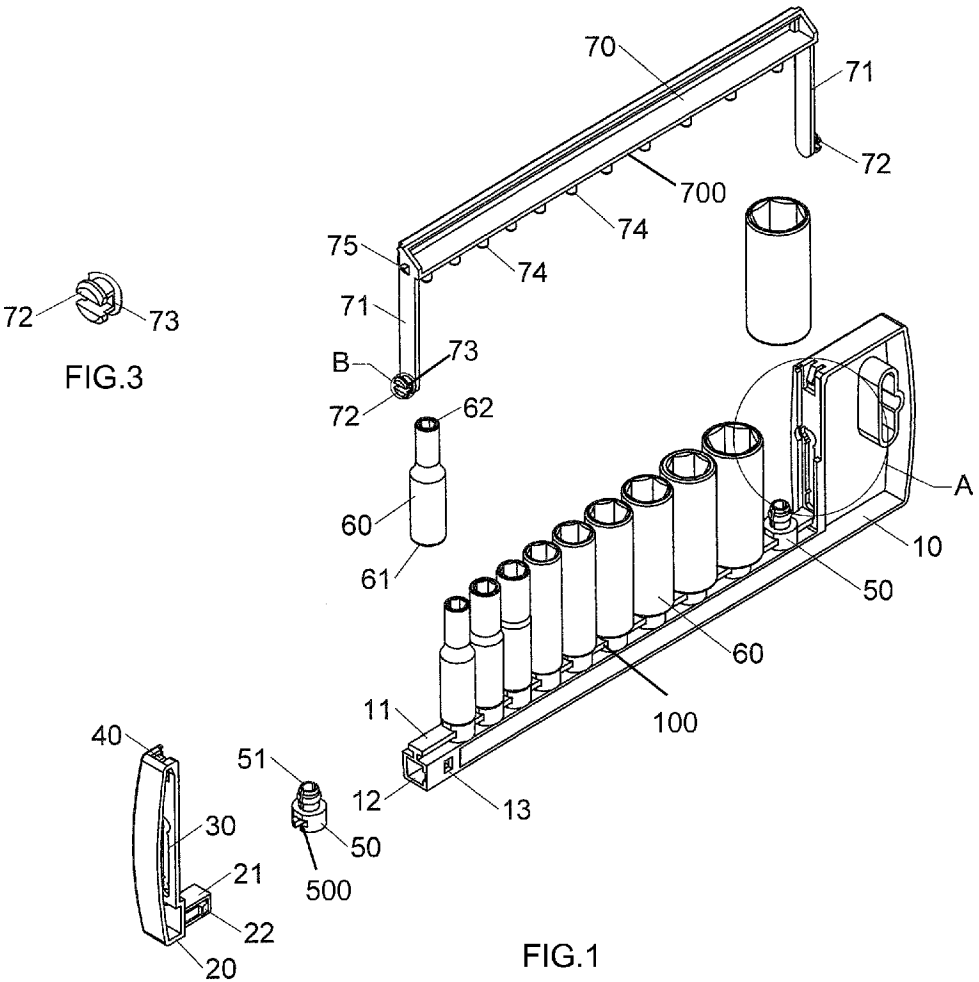
FIG.1
FIG.3

TOOL RACK

FIELD OF THE INVENTION

The present invention relates to a tool rack, and more particularly, to a tool rack which includes a base and a frame which is pivotable relative to the base and supports the tool rack for convenience of access of the tools.

BACKGROUND OF THE INVENTION

A conventional tool rack as disclosed in U.S. Pat. No. 6,092,656 generally includes a body and a connection member, the body has two locking portions respectively located on two sides thereof and a positioning portion is located at the mediate portion of the base. Multiple blocks extend from the positioning portion. The connection member includes multiple rods extending therefrom and located corresponding to the blocks. The connection member has two connection portions respectively located on two ends thereof so as to be connected with the locking portions to connect the base to the connection member. The tools each have two ends which are positioned between the rod and the blocks. However, when picking the tools out from the tool rack, the base and the connection member have to be separated from each other. Furthermore, the connection member can only be put on a horizontal surface and the base can only stand upright. The tools cannot be picked at an angle and this is inconvenient for the users.

The present invention intends to provide a tool rack which allows the users to pick the tools at an angle.

SUMMARY OF THE INVENTION

The present invention relates to a tool rack and comprises a base, two side boards and a frame. The base includes multiple blocks and is located between the two side boards. Each side board has an elongate slot and two ridges between which a space is defined. The elongate slot has a first recess and a second recess respectively defined in the top inner end and the bottom inner end thereof. The first recess is located higher than a top of one of the ridges. The frame has multiple extensions and tools are positioned between the blocks and the extensions. Two side links extend from two ends of the frame. When the frame is mounted to the base, the side links are slidably engaged with the spaces of the side boards. The side links each have a pivot which is movably engaged with the elongate slot and each of the recesses.

The present invention will become more obvious from the following description when taken in connection with the accompanying drawings which show, for purposes of illustration only, a preferred embodiment in accordance with the present invention.

BRIEF DESCRIPTION OF THE DRAWINGS

FIG. 1 is an exploded view to show the tool rack of the present invention;

FIG. 2 is an enlarged view of the circled area A in FIG. 1;

FIG. 3 is an enlarged view of the circled area B in FIG. 1;

DETAILED DESCRIPTION OF THE PREFERRED EMBODIMENT

Figure 4:
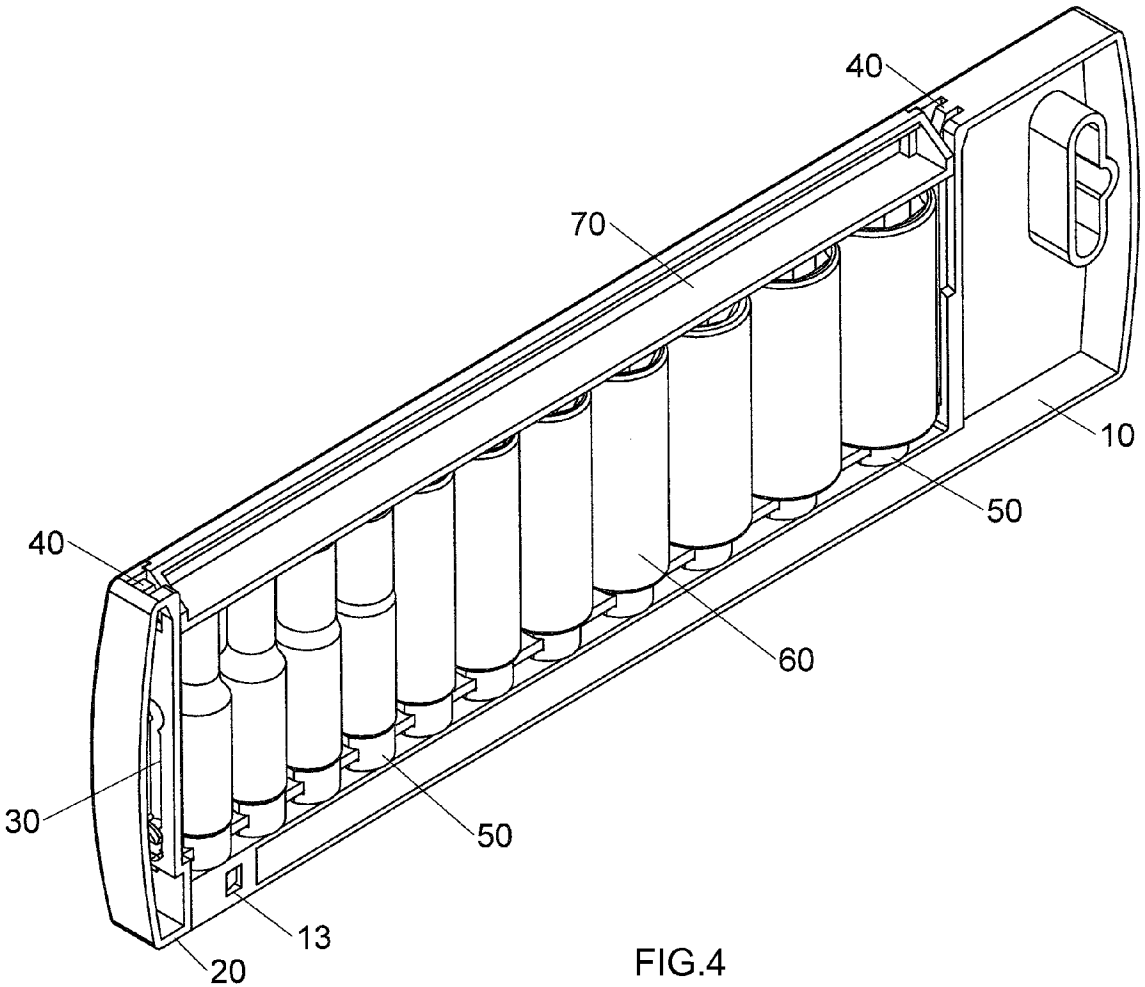
FIG. 4 is a perspective view to show the tool rack of the present invention.
Figure 5:
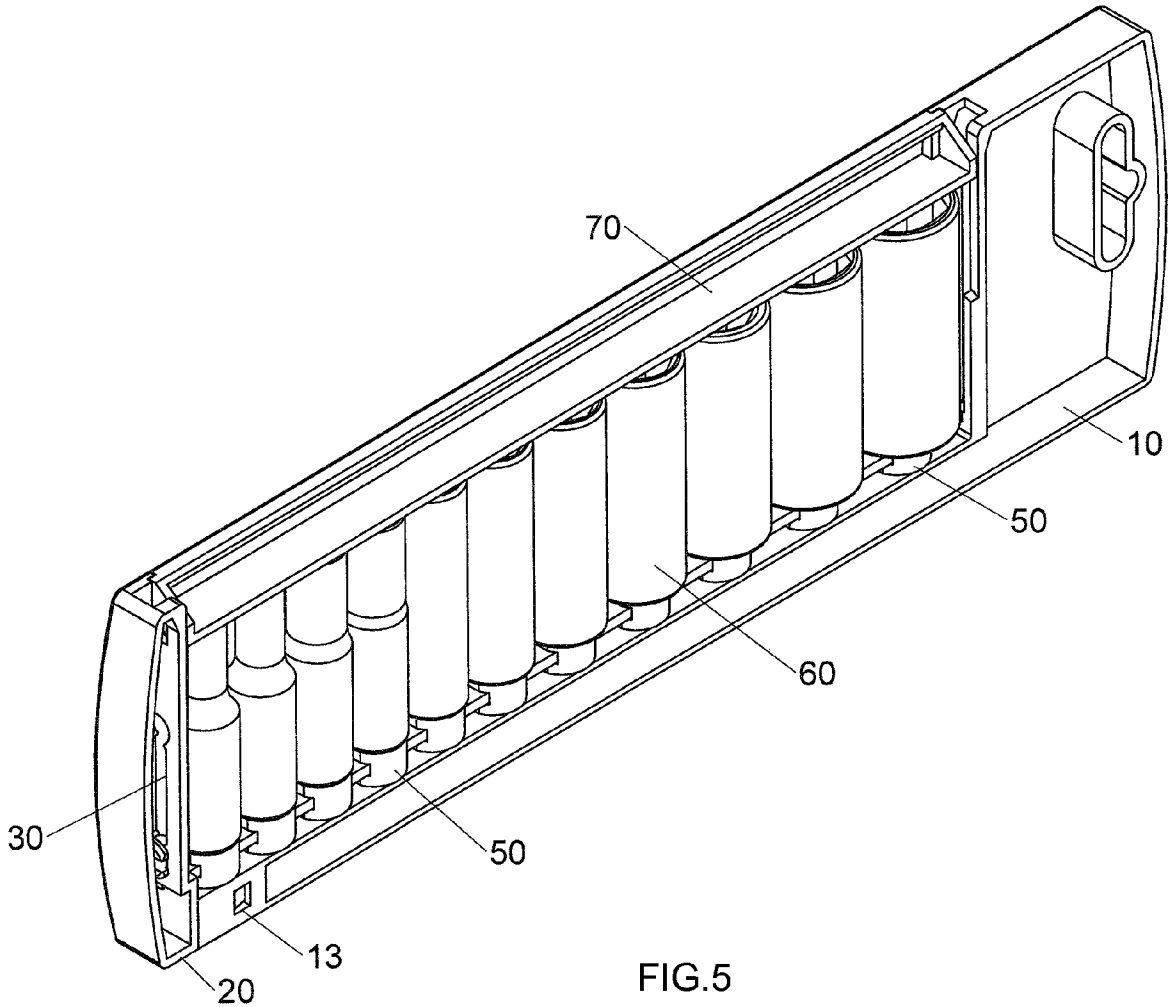
FIG. 5 is a perspective view to show the operative status of the tool rack of the present invention.
Figure 7:
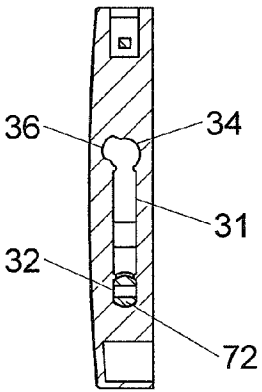
FIG. 7 is a cross sectional view, taken along line D-D in FIG. 6.
Figure 6:
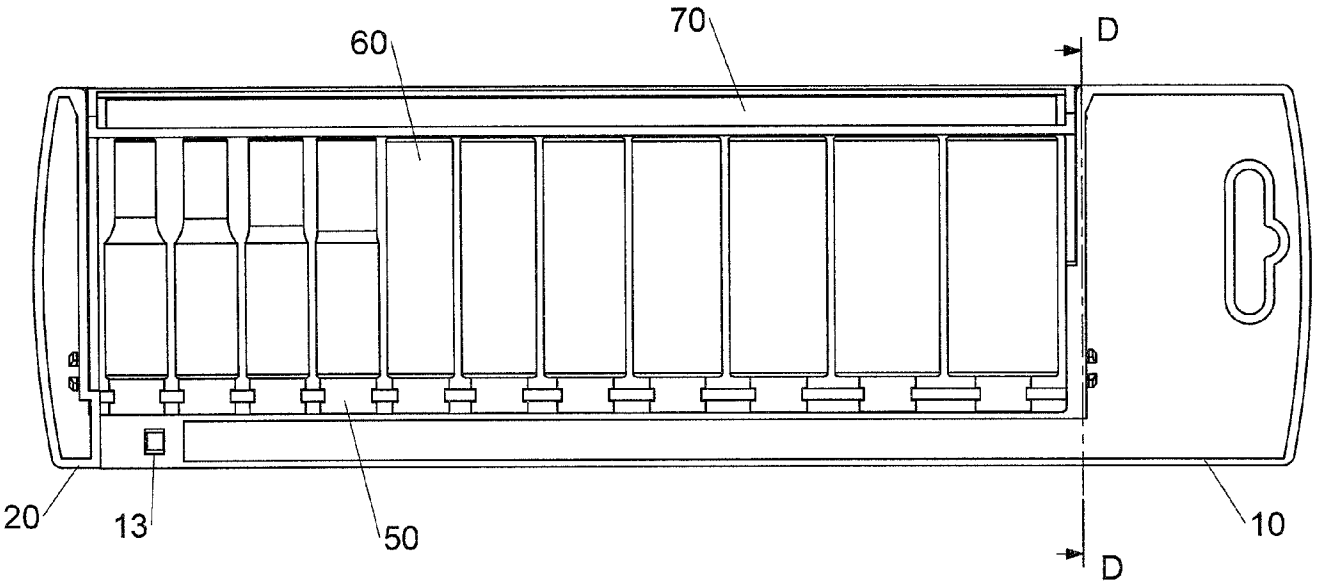
FIG. 6 is a side view of the tool rack of the present invention.

Referring to FIGS. 1 to 3, the tool rack of the present invention comprises a base 10, two side boards 20 and a frame 70. The base 10 has a first positioning portion 100 along the longitudinal direction of the base 10 and multiple blocks 50 extend from the first positioning portion 100. Each block 50 is mounted by a first end of a tool 60. Each block 50 has an engaging portion 51 on the distal end thereof and the tool 60 is mounted to the engaging portion 51. The two side boards 20 extend from the base 10 and are located on two ends of the first positioning portion 100. The two side boards 20 each have an elongate slot 31 defined therein, and a first ridge 38 and a second ridge 380 are respectively located on two sides of each of the two elongate slots 31. A space 381 is defined between the first and second ridges 38, 380. A first recess 32 is defined in the lower inner end of each of the elongate slots 31 and located close to the first positioning portion 100. Two first protrusions 33 respectively extend from two facing insides of each of the elongate slots 31. A second recess 34 is defined in the top inner end of each of the elongate slots 31 and located higher than the top end of each of the second ridges 380. An opened portion 382 is defined between the top end of the second ridge 380 and the top end of the side board 20. Two second protrusions 35 are respectively formed at the conjunction portions between the elongate slot 31 and the second recess 34. A third recess 36 is defined inclinedly in the inside of the second recess 34 and located closer to the elongate slot 31 than the second recess 34.

The frame 70 has a second positioning portion 700 at the mediate portion thereof and multiple extensions 74 extending from the second positioning portion 700 and located along a straight line. The extensions 74 are located corresponding to the blocks 50. Each extension 74 is mounted by the second end of a tool 60. Two side links 71 respectively extend from two ends of the frame 70 and are engaged with the spaces 381 when the from 70 is located at a closed position relative to the base 10. Each side link 71 has a pivot 72 extending from outside thereof, and the pivot 72 is movably engaged with the elongate slot 31, the first recess 32, the second recess 34 and the third recess 36.

Figure 14:
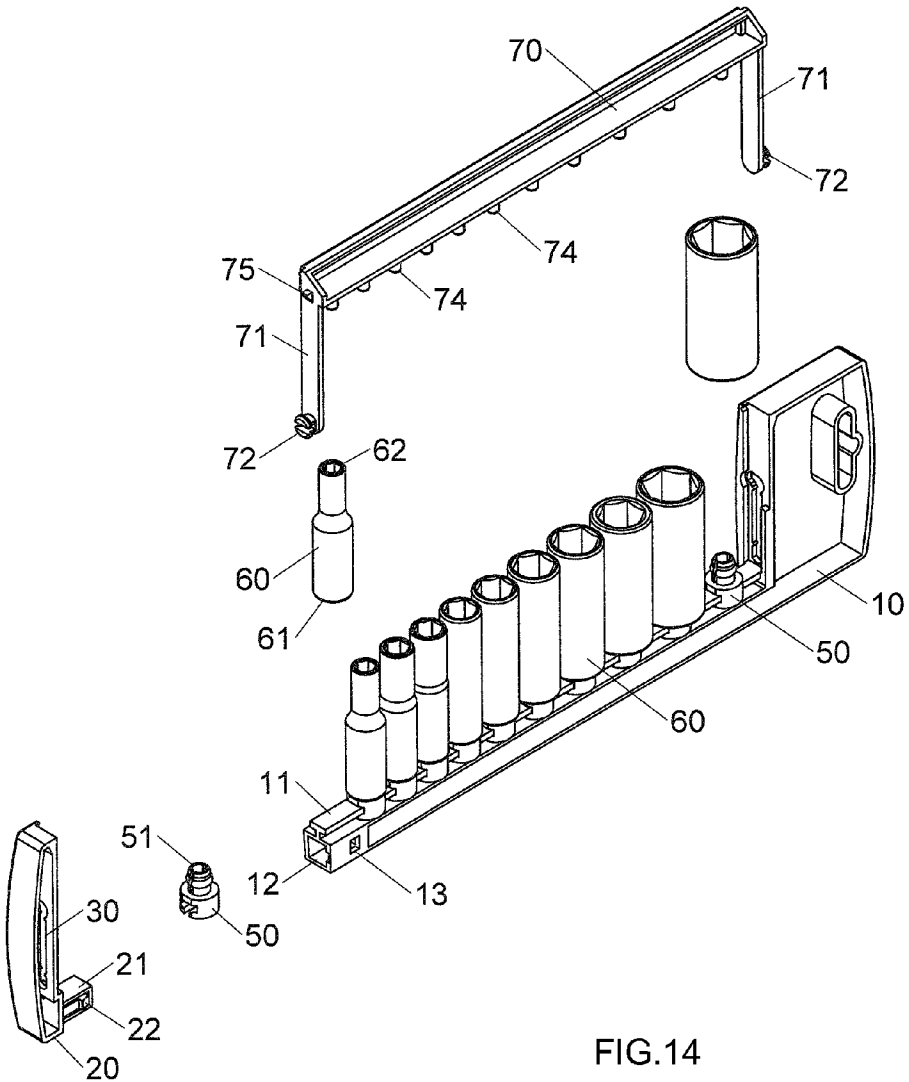
FIG. 14 is an exploded view to show the second embodiment of the tool rack of the present invention.

The two side boards 20 each have a hook 40 and the frame 70 has two bosses 75 respectively located on two ends thereof. The bosses 75 are hooked with the hooks 40. As shown in FIG. 14 which shows another embodiment, the two side boards 20 do not have the hooks 40.

One of the two side boards 20 is an individual part from the base 10 and has an insertion 21 and a side protrusion 22 extends from one side of the insertion 21. The base 10 has an insertion hole 12 and a side hole 13 is defined in the wall of the insertion hole 12. The insertion 21 is inserted into the insertion hole 12 and the side protrusion 22 is engaged with the side hole 13 so that the side board 20 is connected to the base 10. The first positioning portion 100 has a T-shaped cross section and the blocks 50 are separated from the base 10. Each block 50 has a T-shaped slot 500 which opens through the lower end and two sides of the block 50. The T-shaped slot 500 is engaged with the first positioning portion 100 to connect the block 50 to the first positioning portion 100.

Figure 13:
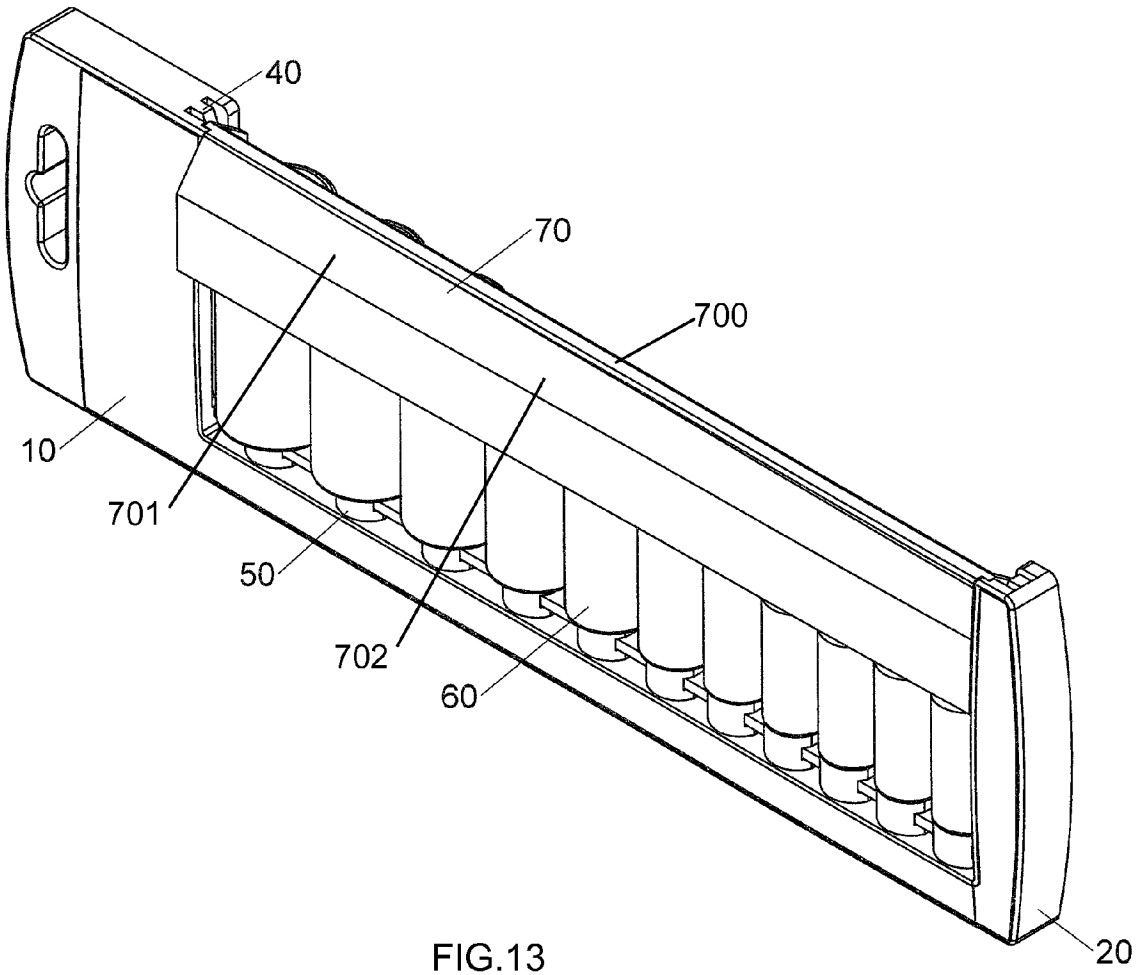
FIG. 13 is a perspective view to show the second embodiment of the tool rack of the present invention.

As shown in FIG. 13, the frame 70 has a plane 701 which is located adjacent to the second positioning portion 700. The plane 701 has multiple index areas 702 which are located corresponding to the extensions 74. Each index area 702 shows the specification of the tool 60 corresponding thereto.

The tools 60 are sockets, connection rods, adapters, universal sockets or universal connectors. As shown in FIG. 1, the tool 60 is a socket.

Figure 8:
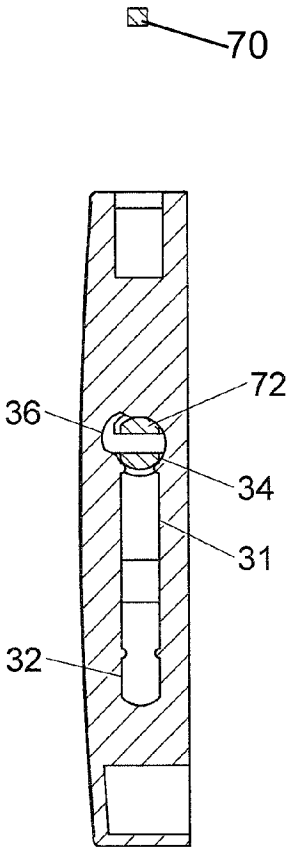
FIG. 8 is a cross sectional view, taken along line D-D in FIG. 6, wherein the frame is located at the second position.
Figure 9:
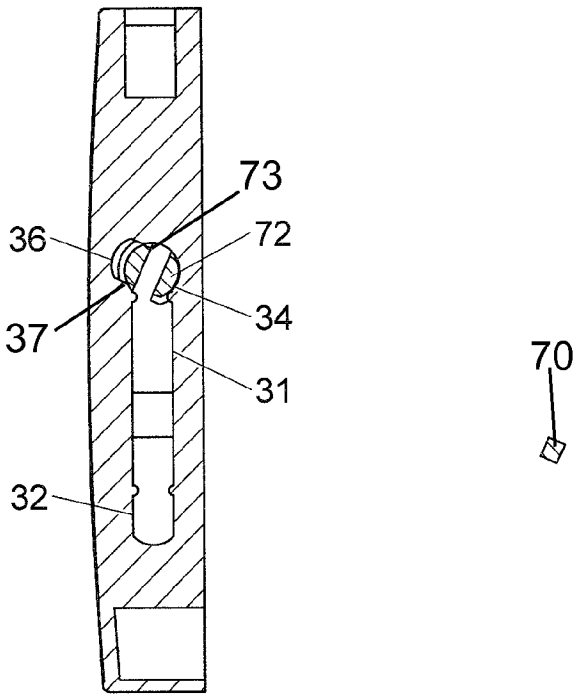
FIG. 9 is a cross sectional view, taken along line D-D in FIG. 6, wherein the frame is located at the third position.
Figure 10:
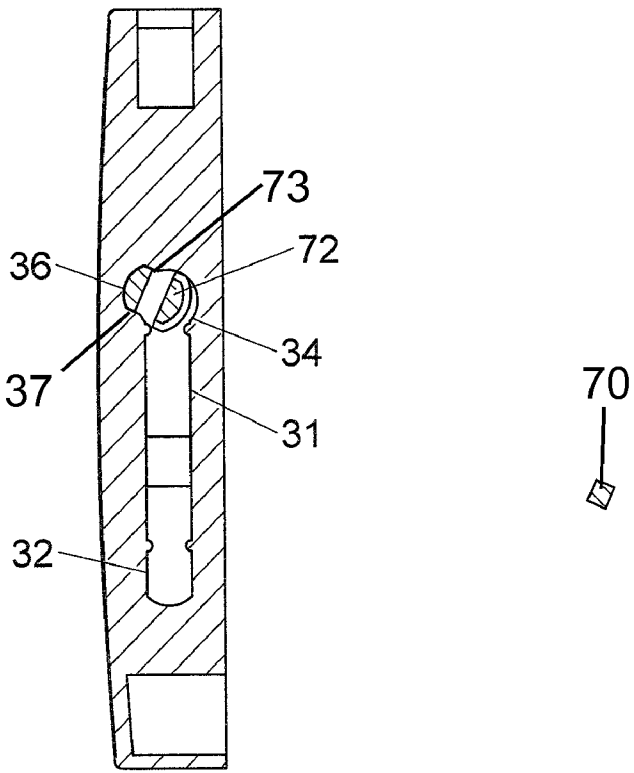
FIG. 10 is a cross sectional view, taken along line D-D in FIG. 6, wherein the frame is located at the fourth position.
Figure 11:
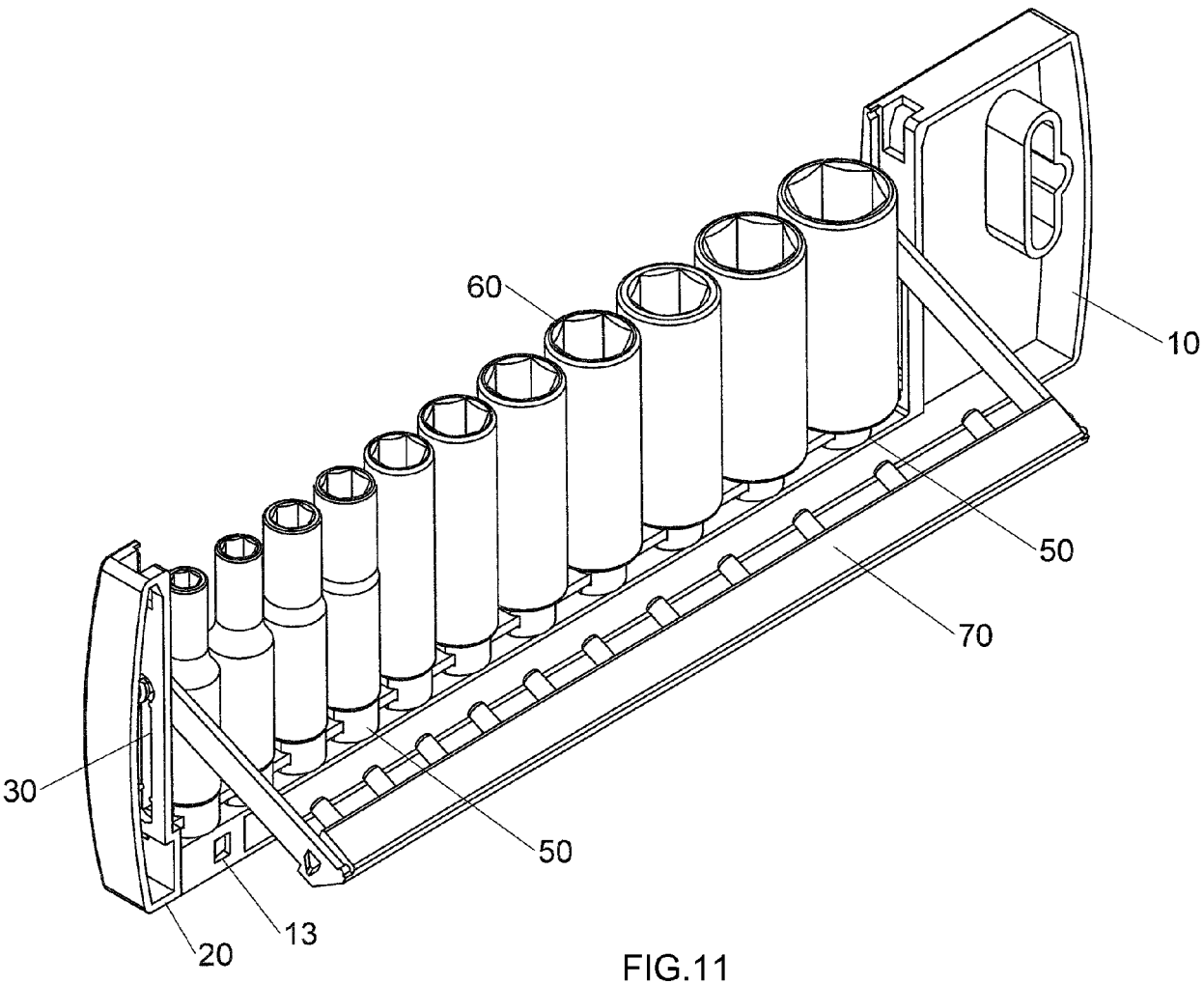
FIG. 11 shows that the tool rack of the present invention is put on a surface.
Figure 12:
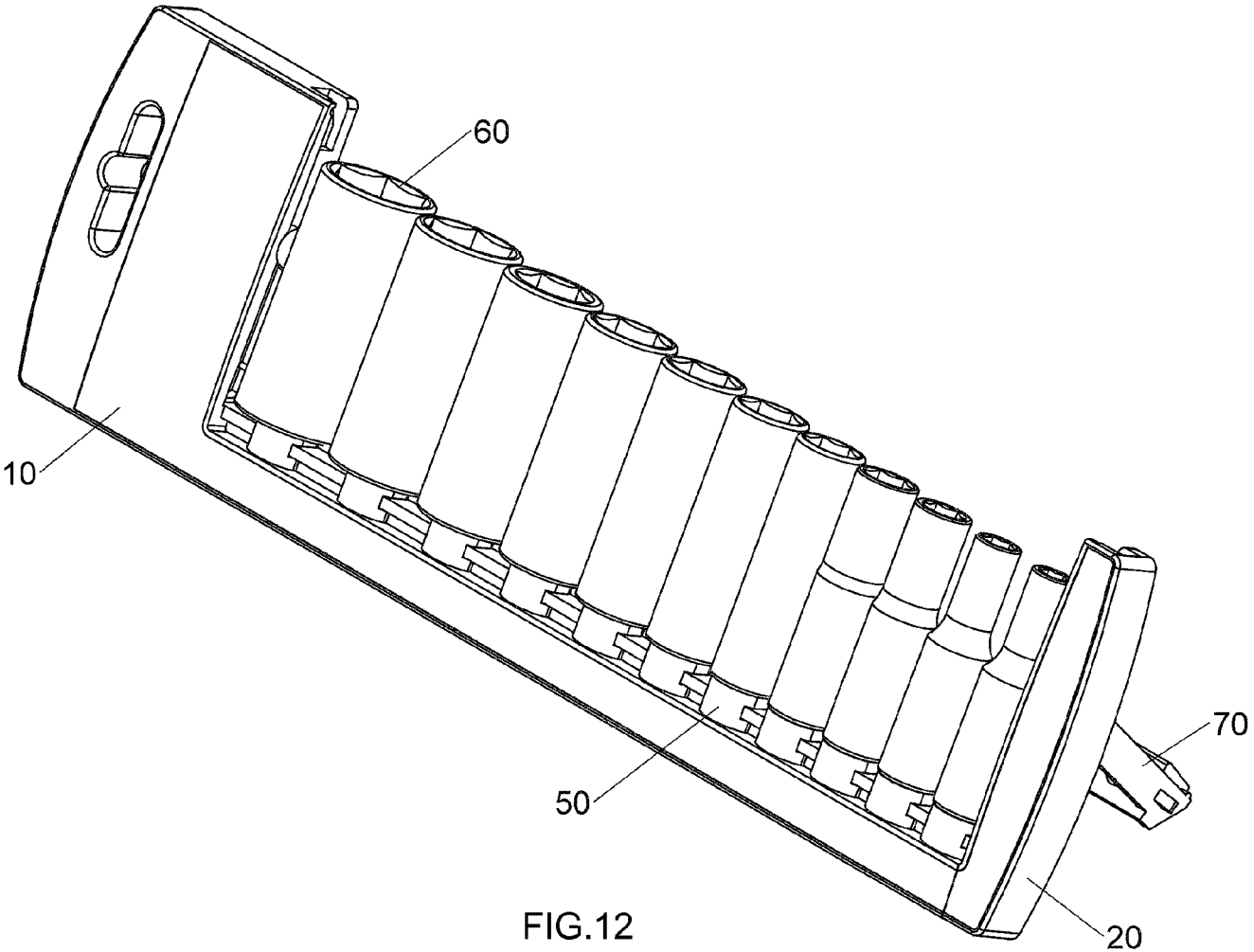
FIG. 12 shows another perspective view of the tool rack of the present invention.

As shown in FIGS. 1 and 5 to 7, when the tool rack is purchased, the frame 70 is mounted to the base 10, the users have to cut the hooks 40 and the frame 70 is pivoted relative to the base 10, so that the pivots 72 are moved from the first recesses 32 and over the first protrusions 33 and then enter into the elongate slots 31. The pivots 72 then move over the second protrusions 35 and enter into the second recesses 34 as shown in FIG. 8. The frame 70 is pivoted relative to the base 10 and moved over the opened portion 382 so that the two flat surfaces 73 of the pivot 72 face the inclined slot 37 as shown in FIG. 9. The width of the inclined slot 37 is designed to fit the distance between the two flat surfaces 73 so that the extensions 74 are separated from the tools 60. As shown in FIGS. 1 and 10, the users pushes the frame 70, the pivots 72 are engaged with the third slots 36 and the two flat surfaces 73 of the pivots 72 are engaged with the insides of the inclined slots 37, and the top ends of the two second ridges 380 contact the mediate portion of the side links 71. As shown in FIGS. 11 and 12, the users then can set the base 10 at an angle on a surface and the frame 70 supports the base 10. The tools 60 can be conveniently picked by the users.

While we have shown and described the embodiment in accordance with the present invention, it should be clear to those skilled in the art that further embodiments may be made without departing from the scope of the present invention.

What is claimed is:

1. A tool rack comprising:

a base having a first positioning portion along an longitudinal direction of the base and multiple blocks extending from the first positioning portion, each block being mounted to a first end of a tool;

two side boards extending from the base and located on two ends of the first positioning portion, the two side boards each having an elongate slot defined therein, a first ridge and a second ridge respectively located on two sides of each said elongate slot, a space being defined between the first and second ridges, a first recess defined in a lower inner end of each of the elongate slots and located close to the first positioning portion, two first protrusions respectively extending from two facing insides of each of the elongate slots, a second recess defined in a top inner end of each of the elongate slots and located higher than a top end of each of the second ridges, an opened portion defined between the top end of the second ridge and a top end of the side board, two second protrusions respectively formed at the conjunction portions between the elongate slot and the second recess, a third recess defined inclinedly in an inside of the second recess and located closer to the elongate slot than the second recess, and a frame having a second positioning portion at a mediate portion thereof and multiple extensions extending from the second positioning portion, the extensions located corresponding to the blocks, each extension being mounted to a second end of a tool, two side links respectively extending from two ends of the frame and engaged with the spaces when the from is located at a closed position relative to the base, each side link having a pivot extending from an outside thereof, the pivot being movably engaged with the elongate slot, the first recess, the second recess and the third recess.

2. The tool rack as claimed in claim 1, wherein an inclined slot is located between the second and third recesses, a width of the inclined slot is defined such that when the pivot is moved from the first recess to the second recess, the frame is pivoted relative to the base, two flat surfaces of the pivot are located to face the inclined slot, when the pivot is engaged with the third recess, the two flat surfaces of the pivot are engaged with two insides of the inclined slot, the top end of the second ridge contacts a mediate portion of the side link.

3. The tool rack as claimed in claim 1, wherein the two side boards each have a hook and the frame has two bosses respectively located on two ends thereof, the bosses are hooked with the hooks.

4. The tool rack as claimed in claim 1, wherein one of the two side boards is an individual part from the base and has an insertion and a side protrusion extending from a side of the insertion, the base has an insertion hole and a side hole is defined in a wall of the insertion hole, the insertion is inserted into the insertion hole and the side protrusion is engaged with the side hole so that the side board is connected to the base, the first positioning portion has a T-shaped cross section and the blocks are separated from the base, each block has a T-shaped slot which opens through a lower end and two sides of the block, the T-shaped slot is engaged with the first positioning portion to connect the block to the first positioning portion.

5. The tool rack as claimed in claim 1, wherein the frame has a plane which is located adjacent to the second positioning portion, the plane has multiple index areas which are located corresponding to the extensions, each index area shows a specification of the tool corresponding thereto.

6. The tool rack as claimed in claim 1, wherein the tools are sockets, connection rods, adapters, universal sockets or universal connectors.

* * * * *